US008365951B2

(12) United States Patent
Jennison

(10) Patent No.: US 8,365,951 B2
(45) Date of Patent: Feb. 5, 2013

(54) ICE AGITATION AND DISPENSING DEVICE AND METHOD

(75) Inventor: Michael T. Jennison, Cranberry Township, PA (US)

(73) Assignee: Akoona LLC, Charlestown (KN)

( * ) Notice: Subject to any disclaimer, the term of this patent is extended or adjusted under 35 U.S.C. 154(b) by 357 days.

(21) Appl. No.: 12/670,536

(22) PCT Filed: Jul. 29, 2008

(86) PCT No.: PCT/US2008/071416
§ 371 (c)(1),
(2), (4) Date: Apr. 7, 2010

(87) PCT Pub. No.: WO2009/018247
PCT Pub. Date: Feb. 5, 2009

(65) Prior Publication Data

US 2010/0219205 A1 Sep. 2, 2010

Related U.S. Application Data

(60) Provisional application No. 60/962,500, filed on Jul. 30, 2007.

(51) Int. Cl.
*B67D 7/84* (2010.01)
*G01F 11/20* (2006.01)

(52) U.S. Cl. ..... 222/1; 222/167; 222/410

(58) Field of Classification Search ..... 222/167, 222/410, 146.6, 333, 460, 368, 369
See application file for complete search history.

(56) References Cited

U.S. PATENT DOCUMENTS

| | | | | |
|---|---|---|---|---|
| 1,495,178 | A * | 5/1924 | Hodgdon | 222/167 |
| 1,722,849 | A * | 7/1929 | Luse | 221/186 |
| 2,317,274 | A * | 4/1943 | Johnson | 222/338 |
| 2,341,265 | A * | 2/1944 | Crawford | 198/443 |
| 2,404,694 | A * | 7/1946 | Cohen et al. | 198/540 |
| 2,684,786 | A * | 7/1954 | Silver et al. | 222/167 |
| 2,721,007 | A | 10/1955 | Matthews | |
| 2,797,070 | A * | 6/1957 | Winn, Jr. et al. | 366/228 |
| 3,207,366 | A | 9/1965 | Feistel, Jr. | |
| RE25,950 | E | 12/1965 | Mueller et al. | |
| 3,272,300 | A | 9/1966 | Hoenisch | |
| 3,276,224 | A | 10/1966 | Lunde | |
| 3,368,723 | A | 2/1968 | Hardeman | |
| 3,390,537 | A | 7/1968 | Callen | |
| 3,446,404 | A * | 5/1969 | Mehta | 222/225 |
| 3,612,307 | A * | 10/1971 | Vogt | 414/220 |
| 4,049,161 | A | 9/1977 | Kohl | |
| 4,062,476 | A | 12/1977 | Brand et al. | |

(Continued)

FOREIGN PATENT DOCUMENTS

GB 2200892 A * 8/1988

*Primary Examiner* — Kevin P. Shaver
*Assistant Examiner* — Matthew Lembo
(74) *Attorney, Agent, or Firm* — The Webb Law Firm

(57) ABSTRACT

An ice dispensing system includes a rotatable barrel (3) having an opening (4); an input chute (2) having a first end coupled to an ice making machine (1) and a second end in communication with the opening (4) when the barrel is in a first position; an output chute (14) in communication with the opening (4) when the barrel (3) is in a second position; a containment system (12) positioned around a portion of the body of the barrel (3); and a drive system (5) coupled to the barrel (3) for rotating the barrel (3). The opening (4) has a geometry and size (15) that directs the ice and captures a regulated amount of the ice during rotation between the first position and the second position. The regulated amount of ice is then dispensed into the output chute (14) when the barrel (3) reaches the second position.

15 Claims, 2 Drawing Sheets

U.S. PATENT DOCUMENTS 4,084,676 A * 4/1978 Motyka et al. ..... 194/297
4,173,239 A * 11/1979 Reiche ..... 144/341
4,817,827 A 4/1989 Kito et al.
4,846,381 A 7/1989 Kito et al.
4,856,682 A 8/1989 Miller et al.
4,913,315 A 4/1990 Wagner
4,969,583 A 11/1990 Torimitsu et al.
5,054,654 A 10/1991 Schroeder et al.
5,299,716 A 4/1994 Hawkins et al.
5,431,311 A * 7/1995 Sigmon ..... 222/368
5,464,126 A 11/1995 Mondini
5,542,573 A 8/1996 Frantz
5,549,219 A 8/1996 Lancaster
5,619,901 A 4/1997 Reese et al.
5,829,085 A * 11/1998 Jerg et al. ..... 8/158
5,829,646 A 11/1998 Schroeder et al.
6,039,220 A 3/2000 Jablonski et al.
6,209,339 B1 4/2001 Schroeder et al.
6,257,009 B1 7/2001 Tsuchikawa
6,305,177 B1 10/2001 Edwards et al.
6,431,414 B2 8/2002 Jaleel et al.
6,607,096 B2 8/2003 Glass et al.
6,871,762 B1 * 3/2005 Cripps ..... 222/142.3
6,964,351 B2 11/2005 Jablonski et al.
7,624,773 B2 * 12/2009 Maxwell ..... 141/114

* cited by examiner

ICE AGITATION AND DISPENSING DEVICE AND METHOD

CROSS REFERENCE TO RELATED APPLICATIONS

This application claims benefit of U.S. Provisional Patent Application No. 60/962,500 entitled "Ice Agitation and Dispensing Device and Method" filed Jul. 30, 2007, which is hereby incorporated by reference in its entirety.

BACKGROUND OF THE INVENTION

1. Field of the Invention

The present invention relates, in general, to a device and method for agitating and dispensing ice (cubes, crushed, cracked, flaked, etc.) from a common mass of stored ice.

2. Description of Related Art

Ice typically cannot be made at the time it is required so it is stored in a common mass and then dispensed accordingly. Ice storage bins are sometimes refrigerated but more typically are only insulated such that the mass of ice slowly melts after entering the bin. Generally, the problems to be overcome by an ice dispensing device and method are to operate consistently without jamming and to dispense a regulated and predictable amount of ice during each activation. Additionally, it is generally desirable for the dispensing method to have the ability to dispense ice consistently whether the storage bin is full or nearly empty, have the ability to dispense ice of various temperatures and consistencies (crunchy frozen ice to slushy melting ice and anything in between), have the ability to dispense ice of different types (various sizes and shapes of cubes, crushed, cracked, flaked), to dispense ice in a form consistent with its original form (crescent cubes, half cubes, crushed, cracked, flaked) and not in big chunks or clumps (agitating method), not dispense "bottom of the bin" ice that is usually the most watery, least desirable, ice in the bin and minimize airflow though the input/output opening(s) of the bin during dispensing to maintain lower temperatures inside the bin.

Methods for dispensing ice from a common mass of stored ice are known in the art. However, each of these methods suffers from various deficiencies that prevent them from achieving the above-described objectives. For instance, U.S. Pat. No. 6,607,096 to Glass et al. is directed to an apparatus and method for a volumetric ice dispensing and measuring device. However, this device is primarily a measuring device. The device dispenses ice using parts which move against ice and therefore can easily jam. Additionally, the device relies on an unreliable measuring of the flow of a solid to regulate the amount of ice dispensed and the device delivers ice from the "bottom of the bin".

A second device for and method of dispensing ice is disclosed in U.S. Pat. No. 5,299,716 to Hawkins et al. This device follows a more common theme of "paddle wheel", "auger" or "conveyor" ice movers. A main feature of this type of ice dispensing device is "staging" ice before dispensing. Ice dispensing devices such as the one described in this reference will not reliably dispense regulated amounts of ice as the "staged" ice is always slowly melting and the time between dispensing activations is variable. Furthermore, this device relies on shaft driven agitators, wheels, conveyors, augers and several other parts that move against ice during operation making it inherently unreliable, prone to jamming and unpredictable.

An additional device for and method of dispensing ice is disclosed in U.S. Pat. No. 3,272,300 to Hoenisch. The device achieves several of the ice dispensing objectives discussed hereinabove; however, it also has moving parts which move against ice and relies on the unreliable physical responses of flowing ice in its loading and conveying mechanism.

A final ice dispensing device is disclosed in U.S. Pat. No. 4,062,476 to Brand et al. This device uses a rotatable supply container thereby eliminating the problem of moving parts against ice. However, it relies on internal fins to "convey" ice towards the discharge opening. Additionally, this device is portable, does not work with ice supply sources and has no method for ice to enter the container.

Accordingly, a need exists for a simple, novel, inexpensive, ice dispensing method that is scalable, reliable and can be used with existing commercial ice making machines. A further need exists for an ice dispensing device that dispenses a consistently regulated amount of ice each activation without any need to measure and that does not include parts that move against ice thereby eliminating any chance of jamming.

SUMMARY OF THE INVENTION

The present invention is directed to an ice dispensing system and method. The system and method of the present invention dispense a consistently regulated amount of ice during each activation without any need to measure and without any chance of jamming since there are no parts moving against ice. Additionally, the ice dispensing system and method of the present invention have the ability to dispense ice consistently whether the storage bin is full or nearly empty, have the ability to dispense ice of various temperatures and consistencies (crunchy frozen ice to slushy melting ice and anything in between), dispense ice of different types (various sizes and shapes of cubes, crushed, cracked, flaked), dispense ice in a form consistent with its original form (crescent cubes, half cubes, crushed, cracked, flaked) and not in big chunks or clumps (agitating method), not dispense "bottom of the bin" ice that is usually the most watery, least desirable ice in the bin and minimize airflow though the input/output opening(s) of the bin during dispensing to maintain lower temperatures inside the bin.

The ice dispensing system of the present invention includes a rotatable barrel comprising a generally cylindrical body portion having an opening; an input chute having a first end coupled to and in fluid communication with an ice making machine and a second end in fluid communication with the opening in the barrel when the barrel is in a first position; an output chute in fluid communication with the opening of the barrel when the barrel is in a second position; a containment system positioned around a portion of the cylindrical body of the barrel; and a drive system coupled to the barrel for rotating the barrel between the first position and the second position. The opening has a geometry and size that directs the ice and captures a regulated amount of the ice during rotation between the first position and the second position. The regulated amount of ice is then dispensed into the output chute when the barrel reaches the second position.

Ice manufactured by the ice making machine may enter the opening of the barrel through the input chute when the barrel is in the first position. The barrel may include at least one drain hole that is substantially smaller than the opening. The cylindrical body of the barrel may be insulated. A secondary cooling unit may be coupled to the input chute to keep the barrel at a below freezing temperature.

The drive system may be a human powered lever, a motor or any combination thereof. The drive system may include a braking system for stopping rotation of the barrel once it returns to the first position. The containment system may be a free spinning mechanical conveyor belt system held around the barrel by tensioning springs or a simple piece of flexible material held around the barrel by tensioning springs. The containment system may have a first end coupled to the input chute or any other fixed member and a second end coupled to the output chute or any other fixed member. The output chute may be configured as a funnel tube. A blade may be positioned near the opening to aid the opening in directing the ice and capturing a regulated amount of the ice during rotation between the first position and the second position. In addition, the rotation of the barrel agitates the ice within the barrel.

The present invention is also directed to a method of dispensing ice. The method begins by providing an ice dispensing system. The ice dispensing system includes a rotatable barrel comprising a generally cylindrical body portion having an opening; an input chute having a first end coupled to and in fluid communication with an ice making machine and a second end in fluid communication with the opening in the barrel when the barrel is in a first position; an output chute in fluid communication with the opening of the barrel when the barrel is in a second position; a containment system positioned around a portion of the cylindrical body of the barrel; and a drive system coupled to the barrel for rotating the barrel between the first position and the second position. Next, the drive system of the ice dispensing system is activated to rotate the barrel from the first position to the second position thereby causing the opening of the barrel to direct ice within the barrel and capture a regulated amount of ice from the barrel. Finally, the regulated amount of ice is dispensed into the output chute when the barrel reaches the second position.

The method may further include draining the barrel through at least one drain hole in the barrel, the at least one drain hole being substantially smaller than the opening. Ice manufactured by the ice making machine may enter the opening of the barrel through the input chute when the barrel is in the first position. The ice dispensing system may further include a secondary cooling unit coupled to the input chute thereby keeping the barrel at a below freezing temperature. The containment system may have a first end coupled to the input chute or any other fixed member and a second end coupled to the output chute or any other fixed member. Rotation of the barrel may agitate the ice within the barrel. A blade may be positioned near the opening to aid the opening in directing the ice and capturing a regulated amount of the ice during rotation between the first position and the second position.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE PRESENT INVENTION

Figure 1:
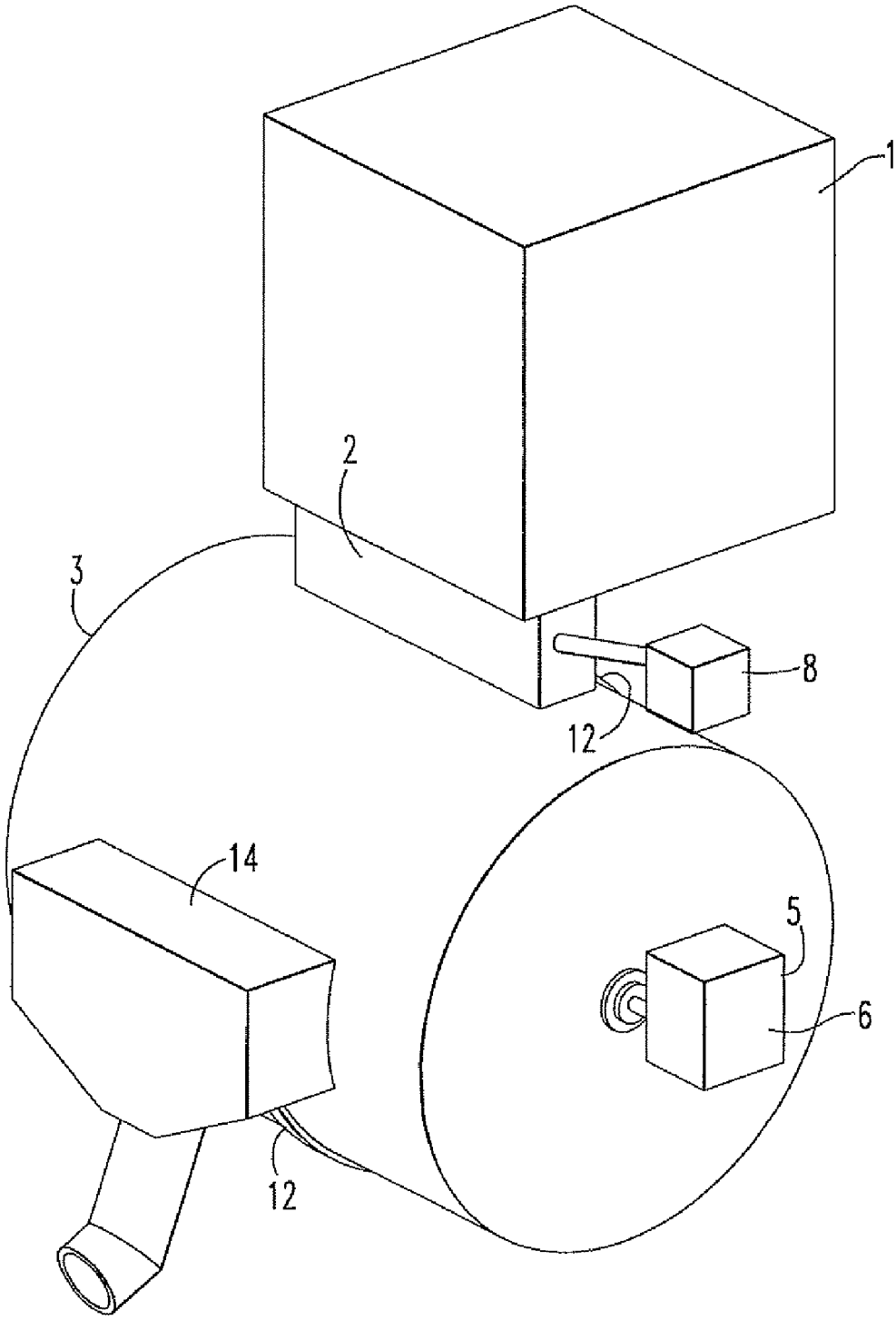
FIG. 1 is an isometric view of an ice dispensing system in accordance with the present invention.

For purposes of the description hereinafter, the terms "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary embodiments of the invention. Hence, specific dimensions and other physical characteristics related to the embodiments disclosed herein are not to be considered as limiting.

Figure 3:
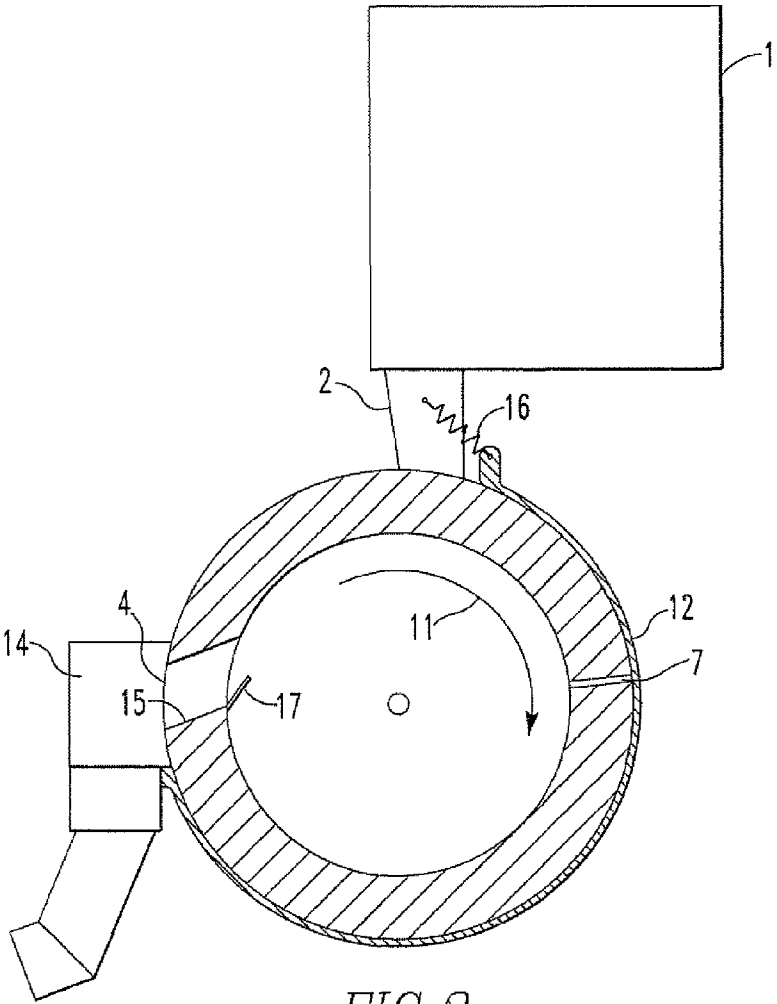
FIG. 3 is a detailed cross-sectional view of the ice dispensing system of FIG. 1 with the barrel in a second position.
Figure 2:
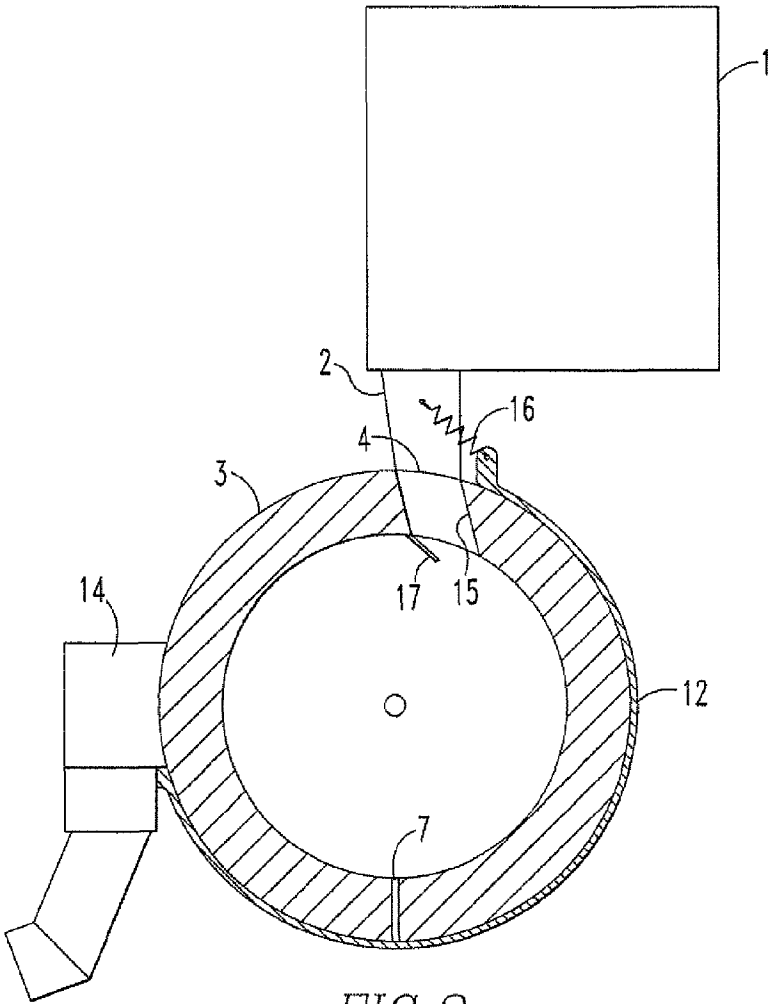
FIG. 2 is a detailed cross-sectional view of the ice dispensing system of FIG. 1 with a barrel of the ice dispensing system in a first position.

With reference to FIG. 1, an ice dispensing system includes an input chute 2, communicating and directing ice into a main ice barrel 3 though a barrel opening 4 (see FIGS. 2 and 3). Input chute 2 is positioned under any conventional ice machine 1 of various types, makes and manufacturers in place of where an ice holding bin would typically be placed. Conventional ice making machine 1 supplies various forms of ice (cubes, crushed, cracked, flaked) to the ice dispensing system of the present invention. The ice produced by ice making machine 1 falls into the dispensing system's input chute 2 and then directly into main ice barrel 3 through opening 4.

With reference to FIG. 2 and with continuing reference to FIG. 1, ice barrel 3 has an insulated cylindrical body with one large barrel opening 4 where ice enters/exits and at least one small drain hole 7. Barrel 3 may include a mounting flange extending from a first end a mounting flange extending from a second end. The mounting flanges are used to mount barrel 3 to an appropriate drive mechanism. Alternatively, barrel 3 may be mounted on a horizontal shaft. Using either mounting configuration, barrel 3 is mounted such that it rotates during operation using a drive system 5 comprising either a human powered lever for small scale units or a powered drive (such as an AC motor) for larger units as will be discussed in greater detail hereinafter. Barrel 3 includes a body that has a cylindrical shape on the outside and a basically cylindrical shape on the inside except for the geometry and size 15 of opening 4 which is contoured so that when opening 4 is rotated, a regulated amount of ice is directed, flows and is captured for dispensing. In addition, a blade or scoop 17 may be added near opening 4 to aid opening 4 in directing and capturing the ice.

Ice barrel 3 stores ice until ice dispensing action is initiated. A majority of the time the ice dispensing system is at a first or idle (i.e., not rotating during a dispensing cycle) position, and barrel opening 4 is aligned with input chute 2 in an upwards orientation, with the at least one drain hole 7 in a downwards orientation. The at least one drain hole 7 is positioned opposite opening 4 such that when barrel 3 is at the idle position, it is in the lowest part of barrel 3 for drainage of melting ice water. Opening 4 is aligned and generally sealed only to input chute 2 which is, in turn, aligned and generally sealed directly to the output of a conventional ice machine 1. This configuration makes for a very well insulated container which allows minimal ambient heat exchange and also benefits from the condenser and cooling function built into conventional ice machine 1. The ice dispensing system may further include a secondary cooling unit 8 that further cools ice barrel 3 to below freezing temperatures by inserting additional cooling at input chute 2.

With reference to FIGS. 1 and 2, ice barrel 3 is positioned and held in place by drive system 5. Drive system 5 is manually driven by a human powered lever for small implementations of the method. In larger implementations of the system, the drive system 5 is mechanically driven by some type of non-human powered mechanical drive, such as, but not limited to, an AC motor, a DC motor, or a pneumatic drive mechanism. Drive system 5 may also contain a standard, conventional braking system 6 to hold barrel 3 in position when at the first or idle position (see FIG. 2) and optionally at a second or discharge position 10. Drive system 5 and braking system 6 shown in FIG. 1 is a standard AC brake motor which works as both the drive and brake system. However, these two functions do not need be contained in a single unit.

With reference to FIGS. 2 and 3, opening 4 accepts ice falling from ice machine 1 though input chute 2 while at a first or idle position (see FIG. 2) and dispenses ice into output chute 14 when barrel 3 is rotated to a second or discharge position (see FIG. 3).

For example, as ice accumulates in barrel 3, standard industrial sensors indicate to the controls of the system that a sufficient quantity of ice is present in barrel 3 to allow ice dispensing. In the case where an excess of ice accumulates in the barrel and an overflow begins up into input chute 2, ice machine 1 will temporarily suspend ice production in an identical way that it does when placed above a traditional ice storage bin which becomes full and overflows. As soon as barrel 3 is rotated to dispense ice, the excess room in barrel 3 immediately fills up with ice from input chute 2 on the next rotation and ice making machine 1 begins producing ice again.

To dispense, barrel 3 is rotated clockwise from the first or idle position (see FIG. 2) though one complete revolution. Each revolution of barrel 3 dispenses a regulated portion of ice based on the size and geometry 15 of opening 4 of barrel 3. Blade or scoop 17, if present, aids opening 4 in directing and capturing the ice. The amount of ice dispensed is consistent each revolution independent of the amount of ice in barrel 3. Upon initiation of an ice dispensing cycle, drive system 5 begins rotating barrel 3 in a clockwise direction indicated in FIG. 3 by arrow 11. The speed of rotation is not critical but should be fairly slow, such as around 10-20 revolutions per minute (rpm).

As opening 4 moves away from input chute 2, ice is contained by an ice containment system 12. Ice containment system 12 is positioned around a portion of the cylindrical body of barrel 3. The ice containment system 12 has a first end and a second end, which are each configured to be secured to any rigid structure in the vicinity of the ice dispensing device such that ice containment system 12 is positioned around a portion of the cylindrical body of barrel 3. For instance, the first end of ice containment system 12 may be coupled to input chute 2 and a second end may be coupled to output chute 14 as shown in FIGS. 2 and 3. In one embodiment of the present invention, ice containment system 12 is a simple piece of flexible material held with an adjustable tension around barrel 3. The flexible material may be secured to a rigid structure either with or without at least one tensioning spring 16. In other embodiments, ice containment system 12 may be a free spinning mechanical conveyor belt system (not shown) held with tension around barrel 3 by tensioning springs. When ice containment system 12 is implemented in such a manner, the conveyor belt system rotates with barrel 3 to reduce friction and torque requirements.

The rotation of barrel 3 agitates the ice therein. In addition, as barrel 3 rotates, the geometry and size 15 of opening 4 directs and captures a regulated amount of ice. Regardless of the quantity of ice contained in barrel 3, and without any need to measure ice by weight, by volume or any other means, as rotating barrel 3 rotates through approximately 270 degrees of rotation, beginning at the first or idle position (see FIG. 2) and approaching the second or discharge position (see FIG. 3), opening 4 is "charged" with the regulated amount of ice for discharge. While the amount of rotation has been described as approximately 270 degrees, this is not to be construed as limiting the present invention as different amounts of rotation may be utilized depending on the geometry and size 15 of opening 4 of barrel 3.

As barrel opening 4 rotates past the end of ice containment system 12 it aligns with the ice output chute 14 as shown in FIG. 3. At this point, the regulated amount of ice captured in opening 4 due to its geometry and size 15 is released from containment and falls into output chute 14. Output chute 14 is a simple fabrication which directs ice to the most beneficial use required for the application. In the present embodiment, it is a funnel tube used to fill up bags or containers with ice.

Barrel drive system 5 then continues rotating barrel 3 in the direction indicated in FIG. 3 by arrow 11 until barrel 3 has completed its rotation. Braking system 6, when used, then stops barrel 3 at the first or idle position (see FIG. 2) to complete one ice dispensing cycle. Alternatively, a shot pin or other locating device (not shown) may be used to insure that the barrel is in the first or idle position.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. An ice dispensing system comprising:

a rotatable barrel comprising a generally hollow cylindrical body portion having substantially closed front and rear ends and an opening positioned on the cylindrical body portion between the front and rear ends;

at least one projection extending from an interior surface of the cylindrical body portion positioned near the opening to aid in directing the ice and capturing a regulated amount of the ice during rotation between the first and second position;

an input chute having a first end coupled to and in fluid communication with an ice making machine and a second end in fluid communication with the opening in the barrel when the barrel is in a first position;

an output chute in fluid communication with the opening of the barrel when the barrel is in a second position;

a containment system to prevent ice from exiting the opening while the barrel rotates from the first position to the second position, comprising a flexible piece of material held in contact with the exterior of the barrel by at least one tensioning spring, wherein the containment system has a first end coupled to the input chute and a second end coupled to the output chute;

a drive system coupled to the barrel for rotating the barrel between the first position and the second position, wherein the opening has a geometry and size that directs ice within the barrel and dispenses the regulated amount of ice into the output chute when the barrel reaches the second position.

2. The ice dispensing system of claim 1, wherein ice manufactured by the ice making machine enters the opening of the barrel through the input chute when the barrel is in the first position.

3. The ice dispensing system of claim 1, wherein the barrel includes at least one drain hole that is substantially smaller than the opening.

4. The ice dispensing system of claim 1, wherein the cylindrical body of the barrel is insulated.

5. The ice dispensing system of claim 1, further comprising a secondary cooling unit coupled to the input chute thereby keeping the barrel at a below freezing temperature.

6. The ice dispensing system of claim 1, wherein the drive system is a human powered lever, a motor or any combination thereof.

7. The ice dispensing system of claim 1, wherein the drive system includes a braking system for stopping rotation of the barrel once it returns to the first position.

8. The ice dispensing system of claim 1, wherein the output chute is configured as a funnel tube.

9. The ice dispensing system of claim 1, wherein rotation of the barrel agitates the ice within the barrel.

10. A method of dispensing ice comprising the steps of:

providing an ice dispensing system comprising:

a rotatable barrel comprising a generally hollow cylindrical body portion having substantially closed front and rear ends and an opening positioned on the cylindrical body portion between the front and rear ends;

at least one projection extending from an interior surface of the cylindrical body portion positioned near the opening to aid in directing the ice and capturing a regulated amount of the ice during rotation between the first and second position;

an input chute having a first end coupled to and in fluid communication with an ice making machine and a second end in fluid communication with the opening in the barrel when the barrel is in a first position;

an output chute in fluid communication with the opening of the barrel when the barrel is in a second position;

a containment system to prevent ice from exiting the opening while the barrel rotates from the first position to the second position, comprising a flexible piece of material held in contact with the exterior of the barrel by at least one tensioning spring, wherein the containment system has a first end coupled to the input chute and a second end coupled to the output chute;

a drive system coupled to the barrel for rotating the barrel between the first position and the second position, activating the drive system to rotate the barrel from the first position to the second position thereby causing the opening in the barrel to direct ice and capture a regulated amount of ice from the barrel; and dispensing the regulated amount of ice into the output chute when the barrel reaches the second position.

11. The method of claim 10, wherein ice manufactured by the ice making machine enters the opening of the barrel through the input chute when the barrel is in the first position.

12. The method of claim 10, further comprising draining the barrel through at least one drain hole in the barrel, the at least one drain hole being substantially smaller than the opening.

13. The method of claim 10, wherein the ice dispensing system further comprises a secondary cooling unit coupled to the input chute thereby keeping the barrel at a below freezing temperature.

14. The method of claim 10, wherein rotation of the barrel agitates the ice within the barrel.

15. An ice dispensing system comprising:

a rotatable barrel comprising a generally hollow cylindrical body portion having substantially closed front and rear ends and an opening positioned on the cylindrical body portion between the front and rear ends;

at least one projection extending from an interior surface of the cylindrical body portion positioned near the opening to aid in directing the ice and capturing a regulated amount of the ice during rotation between the first and second position;

an input chute having an end in fluid communication with the opening in the barrel when the barrel is in a first position; and an output chute in fluid communication with the opening of the barrel when the barrel is in a second position;

a containment system to prevent ice from exiting the opening while the barrel rotates from the first position to the second position, comprising a flexible piece of material held in contact with the exterior of the barrel by at least one tensioning spring, wherein the containment system has a first end coupled to the input chute and a second end coupled to the output chute;

wherein the opening has a geometry and size that directs ice that enters the barrel through the input chute, and dispenses the regulated amount of ice into the output chute when the barrel reaches the second position.

* * * * *

UNITED STATES PATENT AND TRADEMARK OFFICE

CERTIFICATE OF CORRECTION

PATENT NO. : 8,365,951 B2
APPLICATION NO. : 12/670536
DATED : February 5, 2013
INVENTOR(S) : Michael T. Jennison It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 424 days.

Signed and Sealed this
First Day of September, 2015

Michelle K. Lee

Michelle K. Lee
*Director of the United States Patent and Trademark Office*